US009975305B2

(12) United States Patent
Strand et al.

(10) Patent No.: US 9,975,305 B2
(45) Date of Patent: May 22, 2018

(54) REINFORCED CANISTER

(71) Applicant: Graphic Packaging International, LLC, Atlanta, GA (US)

(72) Inventors: Scott Thomas Strand, Lake Elmo, MN (US); Norman L. Jesch, Northglenn, CO (US); Kelly R. Fitzwater, Lakewood, CO (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days. days.

(21) Appl. No.: 15/210,973

(22) Filed: Jul. 15, 2016

(65) Prior Publication Data

US 2017/0029160 A1 Feb. 2, 2017

Related U.S. Application Data

(60) Provisional application No. 62/282,430, filed on Jul. 31, 2015.

(51) Int. Cl.
*B65D 5/44* (2006.01)
*B65D 5/64* (2006.01)
(Continued)

(52) U.S. Cl.
CPC ..... *B31B 17/00* (2013.01); *B65D 3/12* (2013.01); *B65D 3/14* (2013.01); *B65D 3/22* (2013.01); *B65D 77/2024* (2013.01); *B31B 50/001* (2017.08); *B31B 2105/00* (2017.08); *B31B 2110/20* (2017.08); *B65D 15/06* (2013.01);
(Continued)

(58) Field of Classification Search
CPC ..... B65D 5/441; B65D 5/326; B65D 5/64; B65D 3/18; B65D 3/04; B65D 3/06; B65D 5/12; B65D 1/265; B65D 81/3876; B65D 81/3886; B65D 2543/00537; B65D 2543/00638; B65D 5/0209; B65D 5/029; B31B 17/00; B31B 2201/22; B31B 2217/064
USPC ..... 229/106, 400, 4.5, 122.32, 122.31, 229/125.35, 5.5, 5.82; 40/306; 493/152, 493/108, 109, 158; 206/446, 505, 515, 206/519, 520
See application file for complete search history.

(56) References Cited

U.S. PATENT DOCUMENTS 1,515,277 A 11/1924 Root
1,733,674 A * 10/1929 Leiman ..... B65D 3/10 229/4.5
(Continued)

FOREIGN PATENT DOCUMENTS

KR 10-2007-0113467 A 11/2005
WO WO 2009/130043 A1 10/2009
(Continued)

OTHER PUBLICATIONS

International Search Report and Written Opinion for PCT/US2016/042396 dated Oct. 18, 2016.

*Primary Examiner* — Christopher Demeree
(74) *Attorney, Agent, or Firm* — Womble Bond Dickinson (US) LLP

(57) ABSTRACT

A canister for holding one or more products. The canister includes a canister body having a first layer and a second layer laminated to the first layer. The canister body has a bottom end having a bottom panel offset from the bottom of the canister and a top end sealed with a lid.

18 Claims, 8 Drawing Sheets

(51) Int. Cl.

| | |
|---|---|
| ***B31B 17/00*** | (2006.01) |
| ***B65D 5/32*** | (2006.01) |
| ***B65D 77/20*** | (2006.01) |
| ***B65D 3/12*** | (2006.01) |
| ***B65D 3/14*** | (2006.01) |
| ***B65D 3/22*** | (2006.01) |
| *B65D 8/00* | (2006.01) |
| *B31B 105/00* | (2017.01) |
| *B31B 50/00* | (2017.01) |
| *B31B 110/20* | (2017.01) |

(52) U.S. Cl.
CPC ..... *B65D 15/08* (2013.01); *B65D 2577/2025* (2013.01)

(56) References Cited

U.S. PATENT DOCUMENTS

| | | | | |
|---|---|---|---|---|
| 2,281,854 | A | 5/1942 | Miller, Jr. | |
| 2,760,629 | A | 8/1956 | Thagard, Jr. | |
| 2,795,366 | A | 6/1957 | Magill | |
| 2,891,713 | A | 6/1959 | O'Neil | |
| 3,042,285 | A | 7/1962 | Smith | |
| 3,049,277 | A * | 8/1962 | Shappell | B65D 3/22 215/12.2 |
| 3,109,576 | A | 11/1963 | Karl | |
| 3,195,799 | A | 7/1965 | Denenberg | |
| 3,445,049 | A * | 5/1969 | Carpenter, Jr. | B65D 3/10 229/164.2 |
| 3,506,183 | A | 4/1970 | Turpin et al. | |
| 3,669,346 | A | 6/1972 | Leezer et al. | |
| 5,685,480 | A * | 11/1997 | Choi | B65D 3/22 229/103.11 |
| 5,752,646 | A * | 5/1998 | Sandstrom | B31F 1/0038 229/4.5 |
| 5,950,917 | A | 9/1999 | Smith | |
| 7,201,714 | B2 | 4/2007 | Zoeckler et al. | |
| 8,220,701 | B2 | 7/2012 | Fontaine et al. | |
| 8,317,671 | B1 | 11/2012 | Zoeckler | |
| 8,403,819 | B2 | 3/2013 | Zoeckler | |
| 8,403,820 | B2 | 3/2013 | Zoeckler | |
| 8,684,224 | B2 | 4/2014 | House | |
| 2003/0111522 | A1 | 6/2003 | Deering et al. | |
| 2005/0252952 | A1 | 11/2005 | Nomular | |
| 2012/0298733 | A1 | 11/2012 | Xu et al. | |
| 2013/0029823 | A1 | 1/2013 | Zoeckler | |

FOREIGN PATENT DOCUMENTS

| | | |
|---|---|---|
| WO | WO 2015/145600 A1 | 10/2015 |
| WO | WO 2015/145601 A1 | 10/2015 |

* cited by examiner

REINFORCED CANISTER

CROSS REFERENCE TO RELATED APPLICATION

This application claims the benefit of U.S. Provisional Patent Application No. 62/282,430, filed Jul. 31, 2015.

INCORPORATION BY REFERENCE

The disclosure of U.S. Provisional Patent Application No. 62/282,430, which was filed Jul. 31, 2015, is hereby incorporated by reference for all purposes as if presented herein in its entirety.

BACKGROUND OF THE DISCLOSURE

The present disclosure generally relates to packaging and more specifically to canister style packages including, for example, of the type used to package granular products such powdered drink mix and/or similar products.

SUMMARY OF THE DISCLOSURE

In general, one aspect of the disclosure is directed to a container, such as a canister, for holding one or more products. The canister generally includes a canister body having a first layer and a second layer secured to the first layer. The first layer and the second layer can be secured by laminating them together. The canister body generally has a bottom end having a bottom panel offset from the bottom of the canister and a top end, which can be sealed with a lid.

In another aspect, the disclosure is generally directed to a canister comprising a canister body having a first layer and a second layer secured to the first layer. The canister body has a top edge, a bottom edge, a front panel, a back panel, a first side panel, and a second side panel. A bottom blank is attached to the canister body and forms a bottom of the canister. The bottom edge of the canister body extends below the bottom blank.

In another aspect, the disclosure is generally directed to in combination, a reinforced blank and a bottom blank for forming a canister having a canister body and a bottom. The reinforced blank is for forming the canister body and has an inner blank and an outer blank attached to the inner blank. The reinforced blank has a top edge, a bottom edge, a front panel, a back panel, a first side panel, and a second side panel. The bottom blank is forming a bottom of the canister and is shaped for attachment to the canister body formed form the reinforced blank. The bottom edge of the canister body extends below the bottom blank in the canister formed from the reinforced blank and bottom blank.

In another aspect, the disclosure is generally directed to a method of forming a canister from a reinforced blank and a bottom blank. The method comprises obtaining a reinforced blank having an inner blank and an outer blank attached to the inner blank. The reinforced blank has a top edge, a bottom edge, a front panel, a back panel, a first side panel, and a second side panel. The method comprises obtaining a bottom blank, forming the canister body from the reinforced blank by positioning the front panel, back panel, first side panel, and second side panel to form an interior space, and forming the bottom of the canister by attaching the bottom blank to the canister body, the bottom edge of the canister body extending below the bottom blank.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION

The present disclosure generally relates to canisters that contain products, such as, food products, non-food products, liquid products, granular products, etc. The products may be powdered drink mix, for example. Canisters according to the present disclosure can accommodate products of any shape. In this specification, the terms "inner", "interior", "outer", "exterior", "lower", "bottom", "upper", "top", "front", and "back" indicate orientations determined in relation to fully erected and upright canisters.

Figure 1:
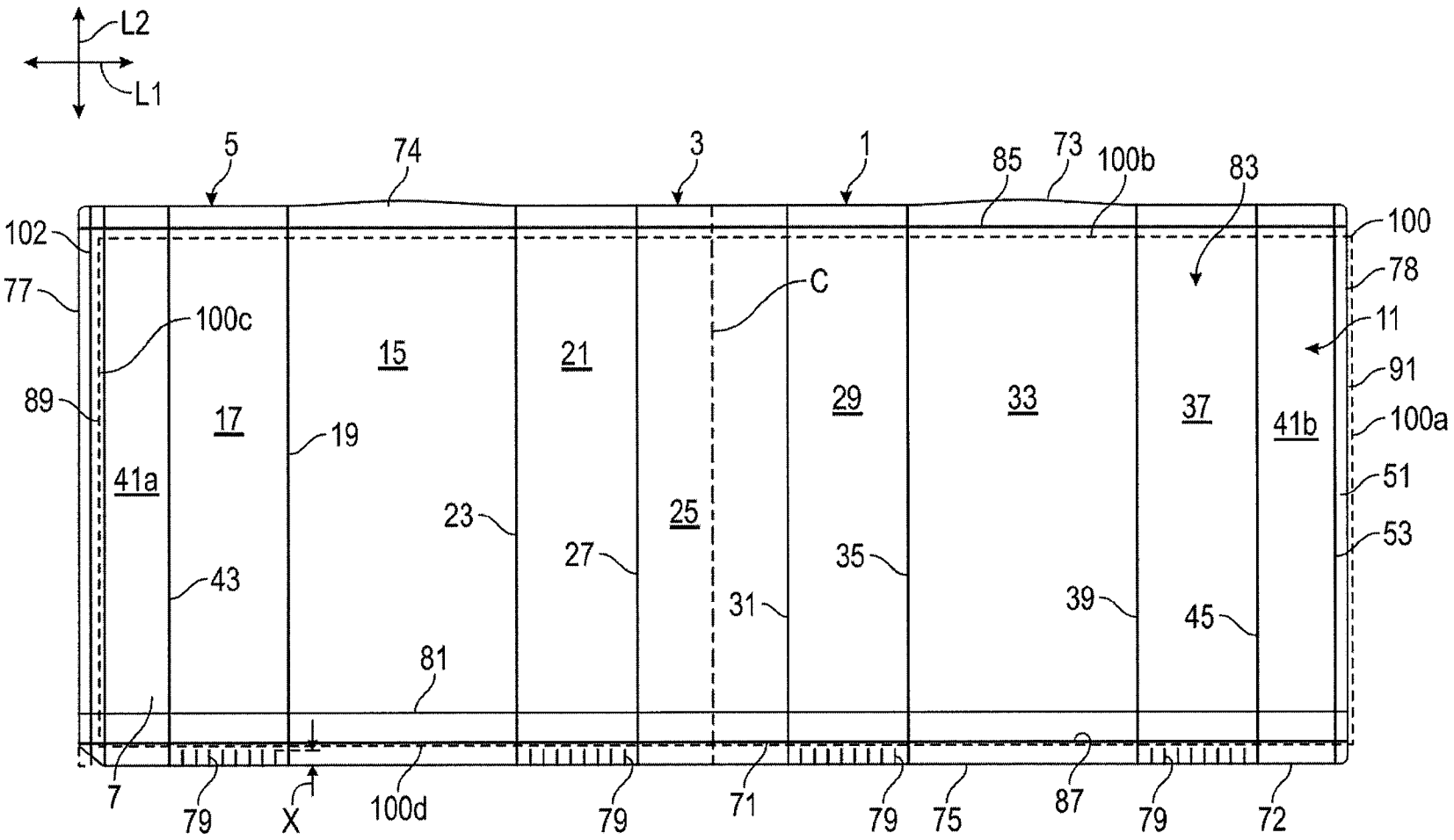
FIG. 1 is a top plan view of a paperboard blank from which a canister according to a first embodiment may be formed.
Figure 2:
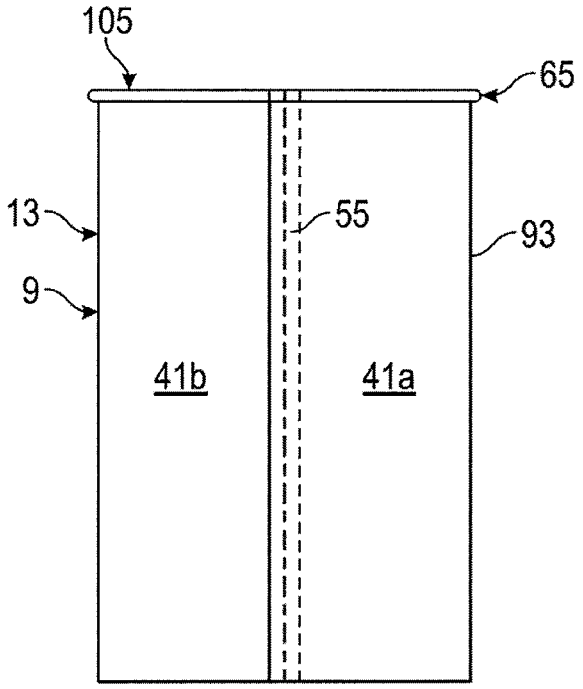
FIG. 2 is a side view of a canister formed from the blank of FIG. 1.
Figure 6A:
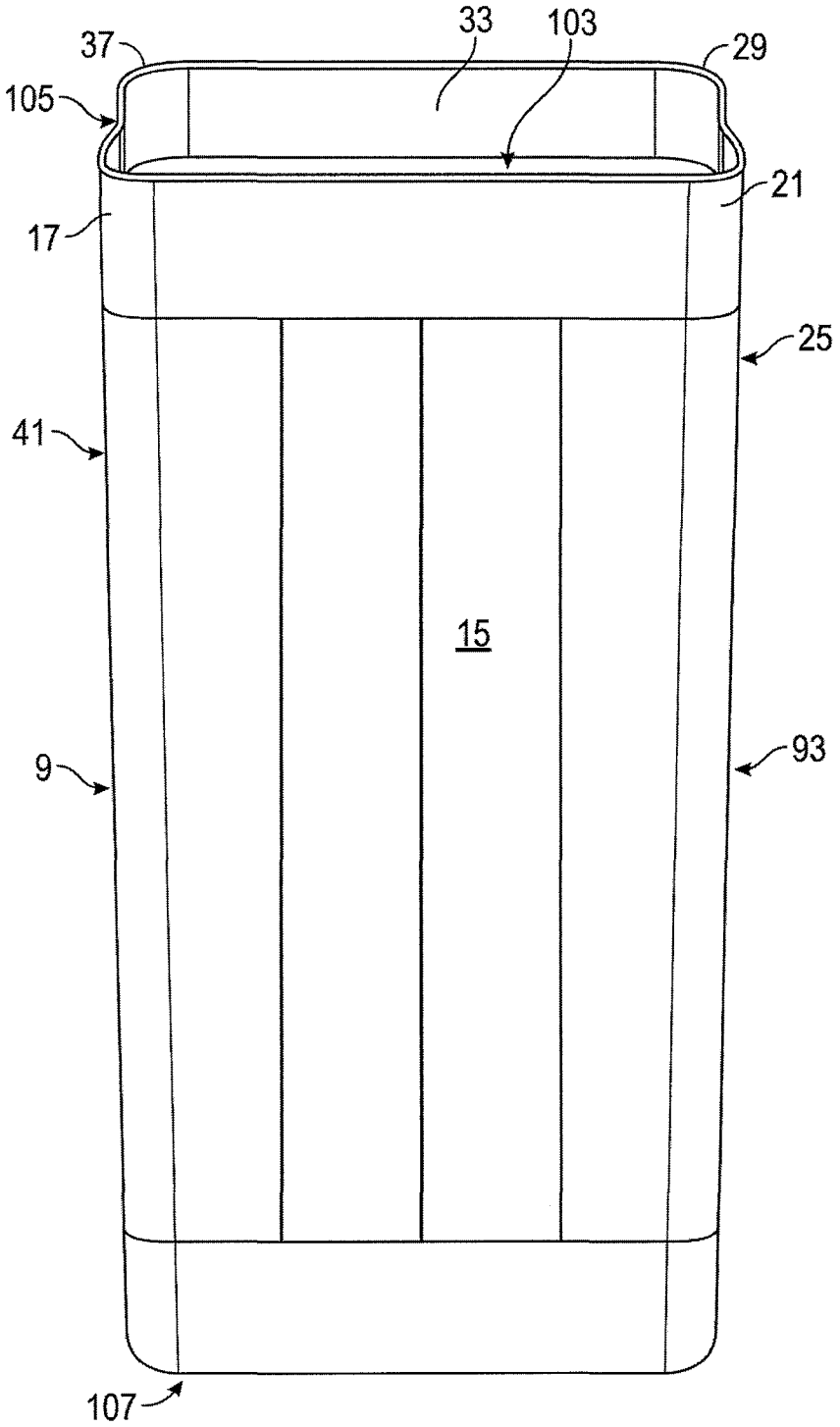
FIGS. 6A and 6B show side views of the canister formed from the blank of FIG. 1.
Figure 6B:
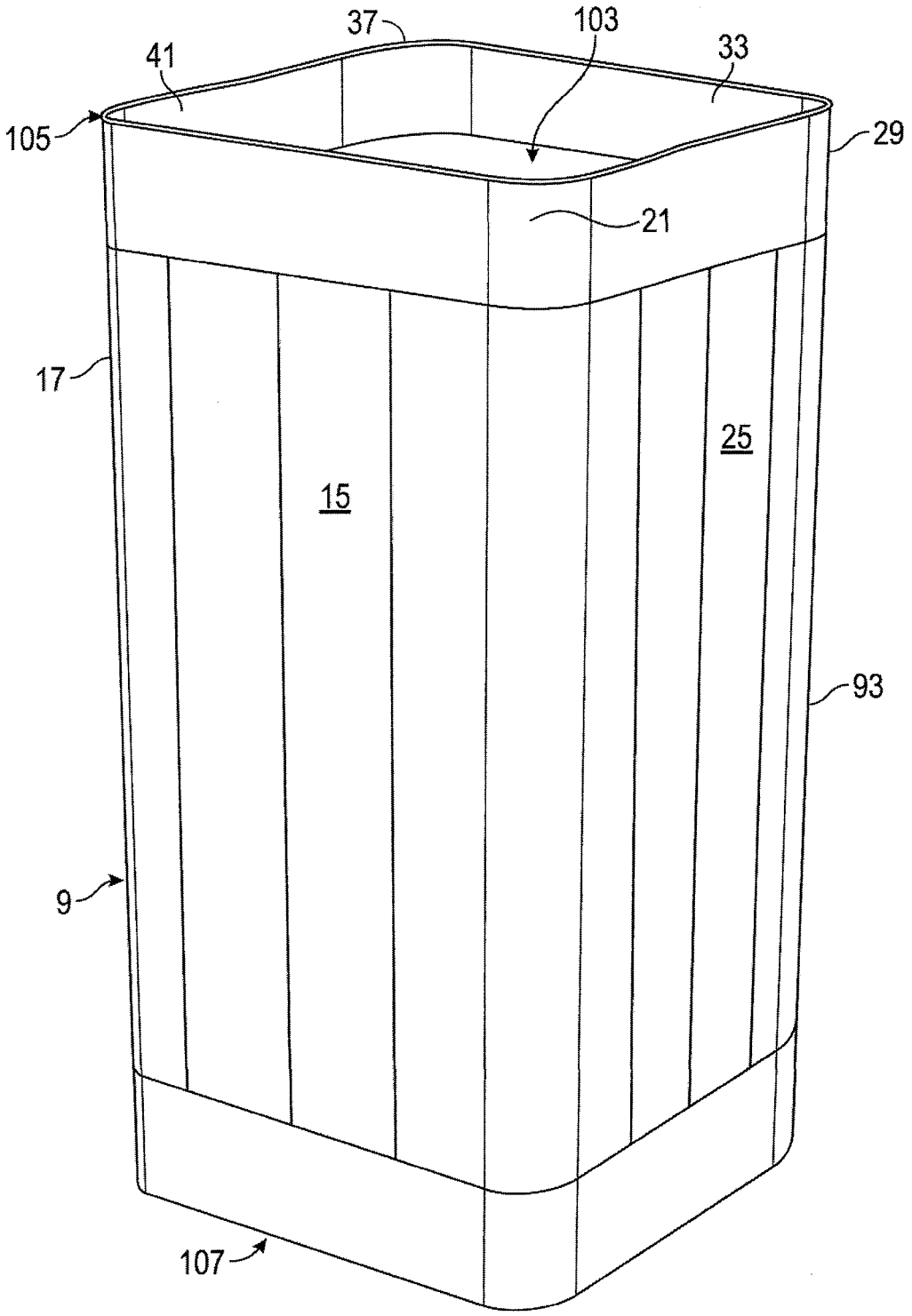

FIG. 1 is a plan view of the interior side 1 of a secured, reinforced, or laminated blank 3 that comprises a first or inner blank, generally indicated at 5, and a second or outer blank 7 attached to the inner blank. In one embodiment, the reinforced blank 3 is generally rectangular in shape and includes an outside surface 9 (FIG. 2) generally corresponding to the exterior surface of the outer blank 7 and an inside surface 11 generally corresponding to the interior surface of the inner blank 5. The reinforced blank 3 can be formed into a reinforced canister 13 (FIGS. 6A and 6B) according to one exemplary embodiment of the disclosure. The canister 13 can be used to house a heavier or denser amount of products compared to non-reinforced canisters. The reinforced blank 3 could have other features and could be otherwise formed or sized without departing from the disclosure.

The laminated blank 3 has a longitudinal axis L1 and a lateral axis L2. As illustrated in FIG. 1, the inner blank 5 includes a front panel 15 foldably connected to a first corner panel 17 at a lateral fold line 19 and a second corner panel 21 at a lateral fold line 23. A first side panel 25 is foldably connected to the second corner panel 21 along a lateral fold line 27 and a third corner panel 29 along a lateral fold line 31. A back panel 33 is foldably connected to the third corner panel 29 along a lateral fold line 35 and a fourth corner panel 37 along a lateral fold line 39. A first portion 41*a* of a second side panel 41 is foldably connected to the first corner panel 17 at a lateral fold line 43 and a second portion 41*b* of the second side panel 41 is foldably connected to the fourth corner panel 37 along a lateral fold line 45. An attachment flap 51 is foldably connected to the second portion 41*b* of the second side panel at a lateral fold line 53. In alternative embodiments, the inner blank 5 can have alternative panel arrangements or no panels or fold lines without departing from the disclosure. For example, in an alternative embodiment the second side panel 41 may include only one panel foldably connected to the first corner panel 17 or the fourth corner panel 37 and may not include two portions as shown. Further, the second attachment flap 51 can overlap the first portion 41*a* of the second side panel 41 to form a seam 55 (FIG. 2) when the blank 3 is formed into a canister 13, or, alternatively, the attachment flap 51 can be folded and secured inside the formed canister 1, with flap 51 inside and behind first portion 41*a*.

In one embodiment the inner blank 5 includes a top edge 73, a bottom edge 75, a left edge 77, and a right edge 78. A portion of the top edge 73 extending along the outer edge of the front and back panels 15, 33 can have a concave radius of curvature with respect to the center of the blank 3. A portion of the bottom edge 75 of the corner panels 17, 21, 29, 37 can include a plurality of lateral score lines 79 extending laterally from the bottom edge 75 toward the center of the blank a distance "x". The distance "x" may be, for example, between 1% to 5% the lateral width of the blank 3. The score lines 79 may be otherwise shaped, arranged, positioned, and/or omitted without departing from the disclosure. In one embodiment, the inner blank may include 8 lateral score lines but the blank may have more or less score lines without departing from the disclosure.

As illustrated in FIG. 1, the inner blank 5 is generally rectangular in shape and includes a longitudinal score/fold line 71 extending longitudinally across the length of the blank. When the blank is formed from the carton, the bottom portion 72 of the inner blank 5, defined below the fold line 71, is folded along the fold line 71 to at least partially form the reinforced bottom 67 of the canister 13.

In one embodiment, the outer blank 7 can be similar in most respects to the inner blank 3. The outer blank 7 can be generally rectangular in shape and includes a top edge 85, a bottom edge 87, a left edge 89, and a right edge 91. The inner blank 5 is larger than the outer blank 7 such that when the reinforced blank 3 is formed the right edge 71 of the outer blank is generally aligned with and corresponds to the right edge 78 of the inner blank 5, the top edge 73 of the inner blank extends beyond the top edge 85 of the outer blank, the left edge 77 of the inner blank extends beyond the left edge 89 of the outer blank, and the bottom edge 75 of the inner blank extends beyond the bottom edge 87 of the outer blank. In one embodiment not shown, the left and right edges 77, 78 of the inner blank can be aligned with and correspond to the left and right edges 89, 91 of the outer blank without departing from the disclosure.

As shown in FIG. 4, the canister 13 includes a bottom blank 95 for forming the bottom of the canister 13. The bottom blank 95 includes a bottom panel 97 and an attachment flap 99 foldably connected to the bottom panel 97 along a fold line 101. The blank may have an optional print area 96 and may have one or more layers without departing from the disclosure. In one embodiment, the bottom blank may have a rounded rectangle shape, however, the bottom blank 95 may be alternatively shape, arranged, and/or positioned without departing from the disclosure.

In one embodiment, the inner blank 5 includes a longitudinal line 81 (e.g., score line) defining the placement location for the canister bottom blank 95. An inside surface or inner wrap 83 is defined between the top edge 85 of the outer blank and the longitudinal line 81 in the inner blank. The inside surface of the inner blank 5 and the bottom blank 95 may be coated with an impervious material such as a polyethylene coating (e.g., SBS foil polyethylene coating) to provide a barrier against moisture and oxygen.

In one embodiment, the exterior 9 of the reinforced blank 3 may include a printable area 100 defined by print bleed lines 100*a*, 100*b*, 100*c*, 100*d*. Print bleed line 100*c* and a tolerance line 102 define the left tolerance for the print bleed area 100.

In one exemplary embodiment, the blank can be assembled by using lamination methods and techniques used to produce Z-FLUTE laminated folding cartons available from Graphic Packaging International, Inc. in Atlanta, Ga. Such laminations methods and techniques may be disclosed in U.S. Pat. No. 7,201,714; U.S. Pat. No. 8,317,671; U.S. Pat. No. 8,403,819; U.S. Pat. No. 8,403,820; and U.S. Patent Application Publication No. 2013/0029823, the disclosures of which are all incorporated by reference herein for all purposes.

Figure 3:
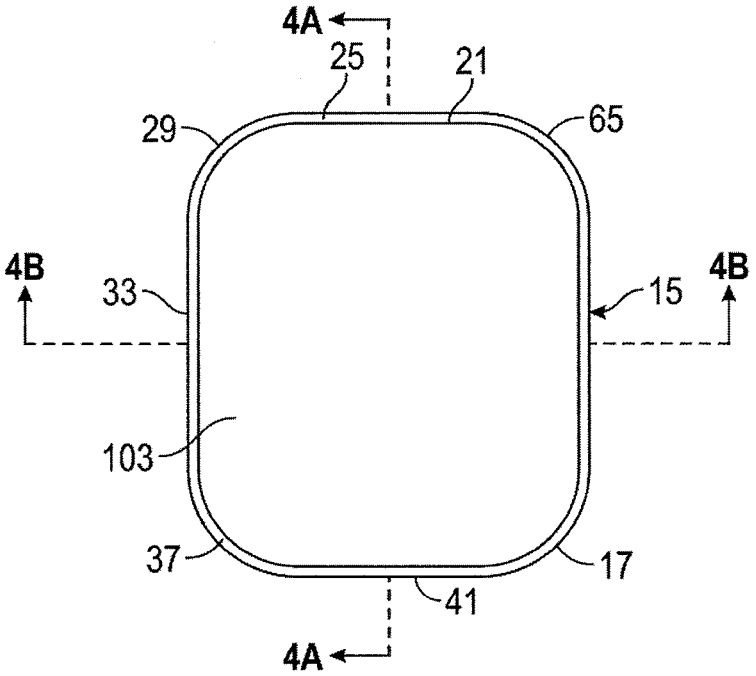
FIG. 3 is a top view of a canister formed from the blank of FIG. 1.
Figure 5A:
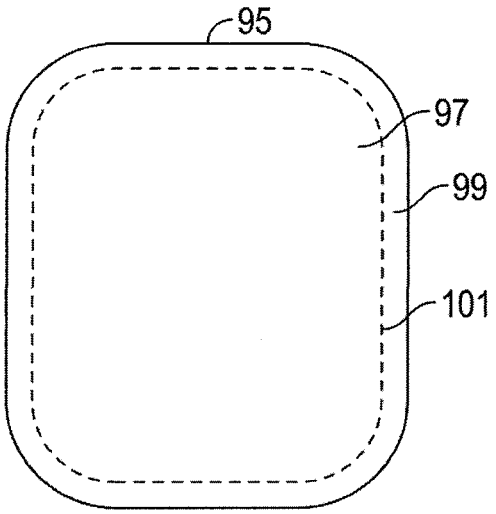
FIGS. 5A and 5B show a barrier membrane layer that can close off the top of the canister formed from the blank of FIG. 1.
Figure 5B:
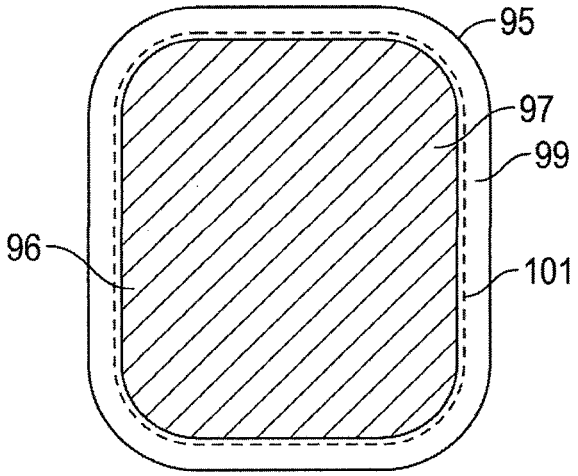

In one embodiment, the reinforced blank 3 is formed by laminating the inner blank 5 and outer blank 7. After obtaining the reinforced blank 3 and bottom blank 95 as shown in FIGS. 1 and 5, the reinforced blank is formed into a tube or canister body 93 (FIG. 2) on a Paper Machinery Corporation (PMC) or like paper canister forming machine. Generally, the bottom blank is aligned with score line 81 and the reinforced blank is rolled into the tube or canister body 93 around the bottom blank. The attachment flap 99 of the bottom blank is folded along fold line 101 and in face-to-face contact with inside surface 11 of the inner blank 5. The reinforced blank may be rolled from its center "C" or from its right edge 78 to its left edge 77 (or vice versa). The attachment panel 51 and first portion 41*a* of the second side panel 41 are sealed together to form the seam 55. The shape of the canister body 93 may generally correspond to the shape of the bottom blank. In one embodiment the canister body 93 may have a generally rounded rectangle tubular shape as shown in FIG. 3, however, the cross-sectional shape of the canister body 93 is not limited to the embodiments shown and may be rounded square, oval, circle, or any other suitable cross-sectional tubular shape.

Figure 4A:
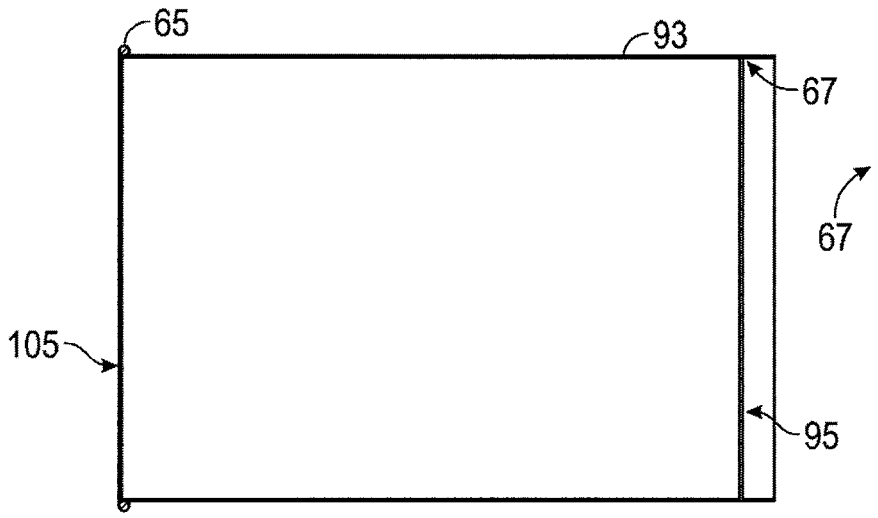
FIGS. 4A and 4B are views of the rim and sealed end of the canister formed from the blank of FIG. 1.
Figure 4B:
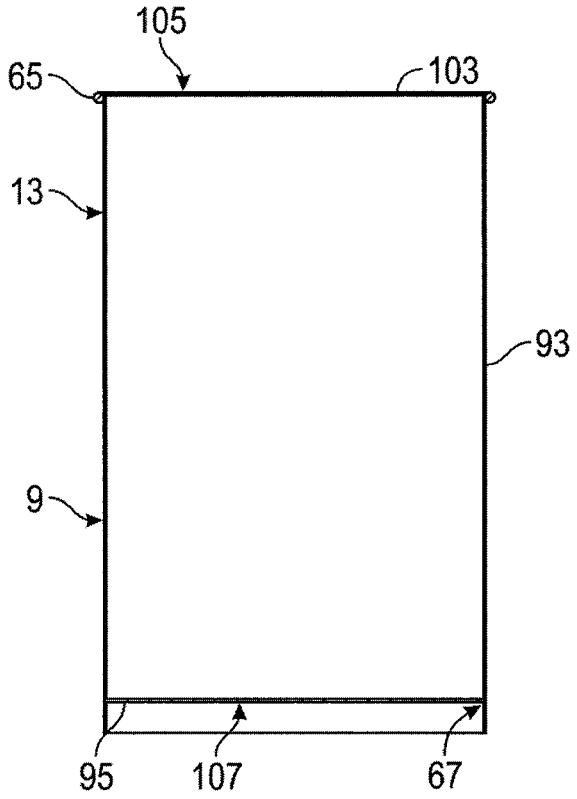
Figure 7:
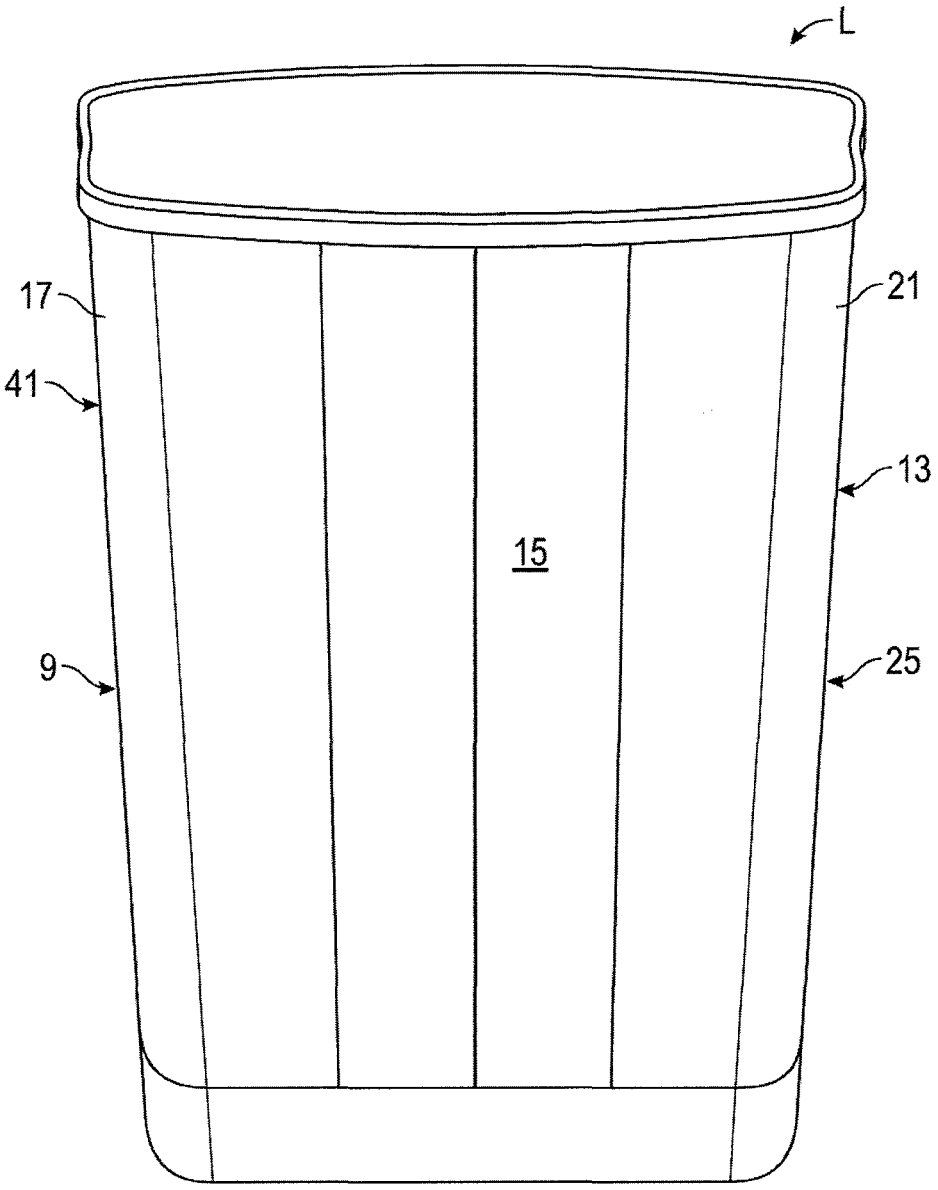
FIG. 7 shows the canister formed from the blank of FIG. 1 with a lid to cover the top.

As shown in FIGS. 4A and 4B, the bottom end 107 of the canister body 93 may be sealed with the bottom blank 95 by folding the bottom portion 72 along fold line 71 to overlap the attachment flap 99 of the bottom blank, adhesive may be added to one or more layers and the layers are pressed together forming the reinforced recessed bottom of the canister 13. A rim 65 as shown in FIGS. 2-5B may be formed before or after the formation of the bottom end 107, by rolling the top portion 74 of the inner blank 5 generally down to the top edge 85 of the outer blank 7. The canister 13 can then be filled with product, whereupon the top 105 of the canister is closed off and sealed with a barrier membrane layer 103 such as foil membrane layer (FIGS. 5A-5B) or other metalized polymer. Alternatively, the canister 13 may be sealed with the barrier membrane before the top end flaps are formed into a rim. A removeable top cap "L" may be applied to the top end 105 of the canister 13 (FIG. 7). The bottom blank, top cap, barrier membrane may be applied in any of a variety of ways as will be recognized by those of skill in the art. Further, the top cap can be formed of paperboard, plastic, metal, or any other suitable material.

To open the canister, a user grasps the top cap L and removes it from the canister 13. The foil membrane 103 is removed or severed around its periphery to permit access to the contents of the canister. The contents can then be poured or scooped out of the canister 13.

Figure 8:
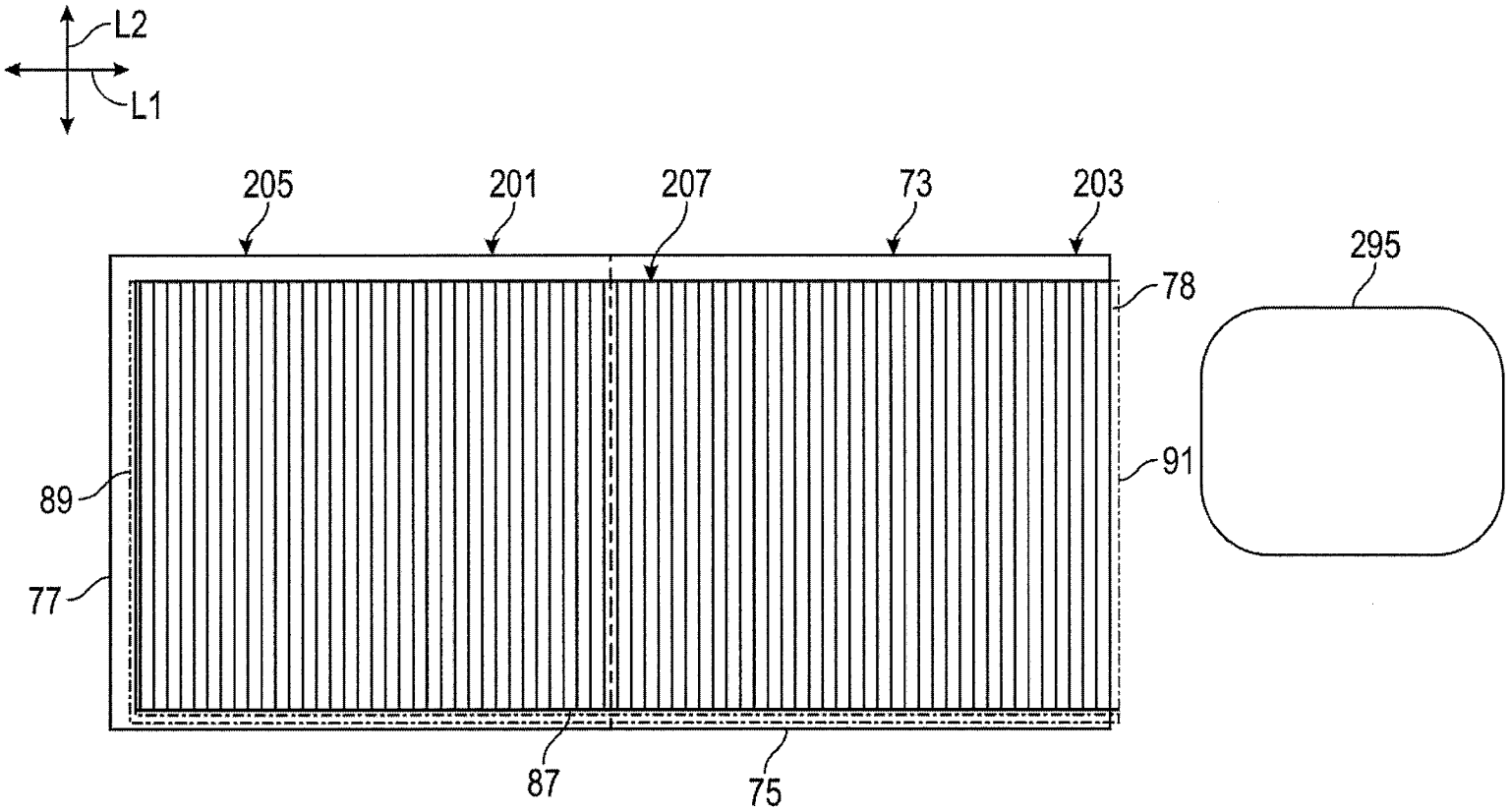
FIG. 8 shows a top plan view of a paperboard blank according to a second embodiment and an outline of a canister that can be formed from the blank.

FIG. 8 illustrates a reinforced paperboard blank 203 from which a canister package (not shown) according to a second embodiment can be formed. Accordingly, similar or identical features of the embodiments are provided with like reference numbers. FIG. 8 is a plan view of the exterior side 201 of a reinforced or laminated blank 203 that comprises a first or inner blank, generally indicated at 205, and a second or outer blank 207 attached to the inner blank. The blank 203 can be formed into a carton with a bottom blank 295 shown in FIG. 8. The reinforced blank 203 could have other features and could be otherwise formed without departing from the disclosure.

The bottom of the second embodiment may be formed similarly as the first embodiment, however the top edge may be formed differently. For example, the top edge 73 may not be rolled forming a rim as illustrated in the first embodiment.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A canister comprising:

a canister body having a first layer and a second layer secured to the first layer, the canister body having a top edge, a bottom edge, a front panel, a back panel, a first side panel, and a second side panel, the top edge comprising a rim, the rim comprising a rolled top portion of the first layer that is rolled down to a first edge of the second layer, wherein a second edge of the second layer extends along the bottom edge of the canister body;

a bottom blank attached to the canister body and forming a bottom of the canister, wherein the bottom blank comprises an attachment flap that is attached to the first layer, the first layer has a bottom portion that is folded along a fold line to at least partially overlap the attachment flap of the bottom blank, and the fold line of the first layer extends along the bottom edge of the canister body, the bottom edge of the canister body extending below the bottom blank.

2. The canister of claim 1, wherein the canister has a top and the top of the canister is closed by a membrane layer covering the top edge of the canister body.

3. The canister of claim 2 wherein the membrane layer is foil or a metalized polymer.

4. The canister of claim 2, wherein the top is closed with a removable cap.

5. The canister of claim 1, wherein the top is closed with a removable cap.

6. The canister of claim 1, wherein the first layer comprises paperboard and the second layer comprises paperboard.

7. The canister of claim 1, wherein the canister body comprises corner panels, each of the corner panels extends between one of front panel and back panel and an adjacent one of the first side panel and second side panel.

8. The canister of claim 7, wherein the corner panels are curved.

9. In combination, a reinforced blank and a bottom blank for forming a canister having a canister body and a bottom, the reinforced blank for forming the canister body and having an inner blank and an outer blank attached to the inner blank, the reinforced blank having a top edge, a bottom edge, a front panel, a back panel, a first side panel, and a second side panel, wherein the inner blank comprises a top portion extending along the top edge of the reinforced blank, a bottom portion, and a fold line extending along the bottom portion, the outer blank comprises an outer top edge and an outer bottom edge, the outer bottom edge extending adjacent the fold line of the inner blank, and the top portion of the inner blank is for being rolled down to the outer top edge of the outer blank to form a rim of the canister body formed from the reinforced blank;

the bottom blank is for forming the bottom of the canister and is shaped for attachment to the canister body formed form the reinforced blank, the bottom edge of the canister body extending below the bottom blank in the canister formed from the reinforced blank and bottom blank.

10. The combination of claim 9, wherein the top edge of the reinforced blank comprises an inner top edge of the inner blank that is spaced apart from the outer top edge of the outer blank.

11. The combination of claim 10, wherein the bottom edge of the reinforced blank comprises an inner bottom edge of the inner blank that is spaced apart from the outer bottom edge of the outer blank.

12. The combination of claim 9, wherein the inner blank comprises paperboard and the outer blank comprises paperboard.

13. The combination of claim 9, wherein reinforced blank comprises corner panels, each of the corner panels extends between one of front panel and back panel and an adjacent one of the first side panel and second side panel, the corner panels being for forming corners of the canister formed from the reinforced blank and the bottom blank.

14. A method of forming a canister from a reinforced blank and a bottom blank; the method comprising:

obtaining a reinforced blank having an inner blank and an outer blank attached to the inner blank, the reinforced blank having a top edge, a bottom edge, a front panel, a back panel, a first side panel, and a second side panel, wherein the inner blank comprises a top portion extending along the top edge of the reinforced blank, a bottom portion, and a fold line extending along the bottom portion, the outer blank comprises an outer top edge and an outer bottom edge extending adjacent the fold line of the inner blank;

obtaining a bottom blank, the bottom blank comprising an attachment flap;

forming a canister body from the reinforced blank by positioning the front panel, back panel, first side panel, and second side panel to form an interior space;

forming a rim of the canister body by rolling the top portion of the inner blank downwardly to the outer top edge of the outer blank so that the rim extends along the outer top edge of the outer blank;

forming a bottom of the canister by attaching the bottom blank to the canister body, the bottom edge of the canister body extending below the bottom blank, the attaching the bottom blank to the canister body comprises attaching the attachment flap to the inner blank, and the forming the bottom of the canister further comprises folding the bottom portion of the inner blank along the fold line to overlap the attachment flap.

15. The method of claim 14, wherein the bottom edge of the reinforced blank comprises an inner bottom edge of the inner blank that is spaced apart from the outer bottom edge of the outer blank.

16. The method of claim 14, wherein the inner blank comprises paperboard and the outer blank comprises paperboard.

17. The method of claim 14, wherein reinforced blank comprises corner panels, each of the corner panels extends between one of front panel and back panel and an adjacent one of the first side panel and second side panel, the forming the canister body comprises positioning the corner panels to form corners of the canister.

18. The method of claim 17, wherein the corner panels are curved to form the corners.

* * * * *